US006463768B1

(12) United States Patent
Shaw et al.

(10) Patent No.: US 6,463,768 B1
(45) Date of Patent: Oct. 15, 2002

(54) COMMERCIAL LAUNDRY MACHINE WITH IMPROVED LOADING HOPPER

(75) Inventors: James M. Shaw, West Chester, OH (US); Michael T. Kroeger, Cincinnati, OH (US)

(73) Assignee: Ellis Corporation, Itasca, IL (US)

( * ) Notice: Subject to any disclaimer, the term of this patent is extended or adjusted under 35 U.S.C. 154(b) by 126 days.

(21) Appl. No.: 09/597,443

(22) Filed: Jun. 20, 2000

(51) Int. Cl.[7] ..... D06F 39/00
(52) U.S. Cl. ..... 68/210
(58) Field of Search ..... 68/210, 144, 145, 68/146; 34/236; 414/13

(56) References Cited

U.S. PATENT DOCUMENTS

| | | | | |
|---|---|---|---|---|
| 1,128,722 | A | | 2/1915 | Renisch |
| 2,282,583 | A | | 5/1942 | Henrici |
| 2,296,265 | A | | 9/1942 | Russell |
| 2,330,605 | A | | 9/1943 | Meyer |
| 3,177,592 | A | | 4/1965 | Meyer |
| 3,400,467 | A | * | 9/1968 | Drace |
| 3,416,438 | A | * | 12/1968 | Weatherly et al. |
| 3,417,582 | A | | 12/1968 | Hertig et al. |
| 3,505,836 | A | | 4/1970 | Langston |
| 3,529,450 | A | | 9/1970 | Pellerin |
| 3,577,751 | A | | 5/1971 | Hertig |
| 3,677,039 | A | * | 7/1972 | Files |
| 3,792,600 | A | | 2/1974 | Hendriksson |
| 4,489,574 | A | | 12/1984 | Spendel |
| 4,835,993 | A | | 6/1989 | Dreher |
| 5,185,941 | A | | 2/1993 | Dongelmans |
| 5,357,772 | A | | 10/1994 | Hendren |
| 5,421,049 | A | | 6/1995 | Hendren |
| 5,713,139 | A | | 2/1998 | Briggs |
| 5,819,437 | A | | 10/1998 | Briggs |

FOREIGN PATENT DOCUMENTS

| | | |
|---|---|---|
| DE | 2 126 844 | 12/1972 |

OTHER PUBLICATIONS

Expo Detergo '85 Catalog (2 pgs.).

* cited by examiner

*Primary Examiner*—Frankie L. Stinson
(74) *Attorney, Agent, or Firm*—Leydig, Voit & Mayer, Ltd.

(57) ABSTRACT

A commercial laundry machine having a loading hopper effective for substantially reducing loading time. The hopper has a relatively large effective passage area for communication with a front opening rotary drum of the laundry machine, and a splash door is pivotally mounted adjacent a front face of the machine housing for movement between a lowered closed position and an upwardly extending open position which neither reduces the effective passage of the hopper chute nor impedes the passage of launderable items directed through the chute. The laundry machine further includes an improved toggle actuated locking and sealing device for securing the hopper in sealed relation with the machine housing, and trunnion mounted hydraulic cylinders which are effective for more reliably and effectively pivoting the hopper unit through an arc greater than 90 degrees to its removed position.

45 Claims, 9 Drawing Sheets

18
30
10
14
11
13
31
20
75
58
59
23
15
19
α

COMMERCIAL LAUNDRY MACHINE WITH IMPROVED LOADING HOPPER

FIELD OF THE INVENTION

The present invention relates generally to commercial/industrial washing, drying, dyeing and like laundry machines, and more particularly, to a commercial laundry machine having a hopper that facilitates loading of launderable items into the machine prior to a laundry cycle.

BACKGROUND OF THE INVENTION

Commercial/industrial laundry machines typically are large in size (i.e., 100 to 1200 pound in capacity) for laundering large amounts of items simultaneously. Apart from the actual laundering cycles, i.e. for example, the washing and extract cycles, a substantial amount of time is consumed in loading large quantities of items to be laundered into the laundry machine. As will be appreciated, the time consumed in loading the laundry machine restricts the actual operating time. Thus, the time associated with loading the laundry machine has a significant impact on the operational efficiency of the commercial laundry facility.

One common method of loading commercial laundry machines involves transporting bag-like slings containing launderable items along an overhead sling conveyance system to a position above the laundry machine and then opening the sling to drop the launderable items into the laundry machine. To facilitate such loading, it is known, as disclosed in U.S. Pat. No. 5,357,772 (hereinafter the "'772 patent"), to tilt the front opening end of the laundry machine drum upwardly from a normal horizontally-oriented operating position and to utilize a chute-like hopper to guide items into the drum as they are released by the overhead sling. The hopper, which is in the form of a rectangular cross section trough, includes a splash door mounted within the hopper for pivotal movement between an open position which permits items to pass through the hopper into the drum opening and a closed position covering the drum opening during a washing cycle after the drum is returned to its horizontal position. Following completion of a laundering cycle, the hopper is moved away from the front of the laundry machine drum to enable unloading of the laundered items by tilting of the front opening end of the drum in a downward direction.

Unfortunately, the prior art arrangement disclosed in the aforesaid '772 patent does not appreciably shorten the loading cycle time. In fact, the hopper unit restricts the drum opening through which the launderable items are introduced into the drum. In commercial laundry machines made pursuant to the '772 patent, the effective opening or passageway of the hopper, as defined by the smallest cross-sectional area through the hopper, has been found to be less than 50 percent of the area of the drum opening. Moreover, since typically as many as six 200 pound slings of launderable items can be required to fill a commercial washer, sequencing of the slings to the unloading position and directing the items into the laundry machine can be very time consuming. Heretofore, up to 35–50 percent of the time necessary for completing a laundering operation can be occupied by loading the machine.

Use of loading hoppers in conventional commercial laundry machines, furthermore, has been problem prone. Items introduced into the hopper during loading can catch upon or fall behind the splash door, which can impede its operation. Items also can hang up in the hopper and the splash door if water is not continually sprayed down the hopper to assist in moving the items into the drum, which can result in raising the liquid within the drum above the programmed level and necessitate a drainage cycle prior to start of washing. Wet items piled in the hopper further can require the splash door actuating mechanism to incur excessive stresses in causing the splash door to forcefully push items hung up in the hopper into the drum opening as an incident to closing, or alternatively, an employee must climb up on the machine to manually force the items into the laundry machine. With the splash door pivot mounting exposed to water and chemicals, films also can build up which impede movement of the splash door, while dirt and soil can accumulate in the hopper behind the door.

Moreover, during the extract cycle of operation, i.e. the high speed spin cycle that forces liquid from laundered items following a wash cycle, the machine can experience extensive vibrations, particularly if the laundry load becomes out of balance. Indeed, during the extract cycle,. items rotating within the laundry machine can be exposed to forces up to 300 times gravity. While it is known to support the laundry machine on inflated bags during the extract cycle for better isolating the machine from the floor, since the hopper is mounted on the laundry machine, it still can be subjected to such severe vibrations as to cause structural failure to the hopper, or its support and actuating mechanisms.

Problems further have been incurred in maintaining the hopper in a securely closed and sealed condition against the laundry machine housing during the washing operation as is necessary in order to prevent leakage of the washing fluid. It is known to use hopper locking devices which include cams that force the hopper into engagement with an interposed sealing gasket. Such cam actuated devices tend to over compress the gasket causing a permanent set. The cams also can incur wear. The combined effect is that over time the cam locking devices can develop a looseness to the extent that leakage about the door can occur and machine vibrations ultimately can cause the loose camming device to forcefully strike and break adjacently mounted proximity switches intended to monitor the locked condition of the hopper.

Since the loading hoppers of conventional laundry machines are relatively massive, problems further have been incurred in reliably raising the hopper to an unloading position following a laundry cycle. While it is desirable to pivot the hopper at least 90 degrees away from the front face of the laundry machine so as not to impede the discharge of items during unloading, heretofore this has required costly and complex operating mechanisms. For example, proposals for raising the hopper by means of large actuating cylinders mounted in front of the laundry machine impede access to the machine and movement of unloading conveyors in front of the laundry machine. Efforts to locate actuating cylinders on the machine itself, and at locations that do not impede access to the machine or increase the floor footprint or height of the machine, have not been found to be effective or reliable in lifting and retaining the heavy hopper unit.

OBJECTS AND SUMMARY OF THE INVENTION

It is an object of the present invention to provide a commercial laundry machine having a loading hopper designed to substantially reduce the loading time, and hence, substantially improve operating efficiency of the laundry machine. In this regard, a more particular object is to provide a commercial laundry machine having a loading hopper effective for reducing the loading time by more than half and for improving the overall machine productivity of the laundry machine by 25 percent or more.

Another object is to provide a commercial laundry machine as characterized above which is adapted for directing larger quantities of items into the laundry machine drum during loading. In this regard, it is an object to provide a commercial laundry machine in which the hopper is effective for receiving launderable items from much larger loading slings so as to reduce by up to 50 percent the number of slings that must be handled during loading of the laundry machine.

A further object is to provide a commercial laundry machine having a hopper with a splash door which when in an open position neither restricts the size of the access opening to the laundry machine drum, nor impedes movement of goods introduced into the hopper. A related object is to provide such a commercial laundry machine and hopper in which the splash door, in fact, facilitates direction of goods into the hopper and laundry machine drum.

Another object is to provide a commercial laundry machine having a hopper with a design that facilitates transfer and direction of launderable items into the laundry machine during loading and which reduces stress concentrations and structural failures in the hopper during usage.

Still another object is to provide a commercial laundry machine having a hopper lifting device that neither impedes access to the machine, nor movement of unloading conveyors in front of the machine. In this regard, it is an object to provide a hopper lifting device that is effective for reliably pivoting the hopper unit at least 90 degrees with respect to the front face of the laundry machine, while not increasing the floor footprint or height of the machine. Yet another object is to provide a commercial laundry machine having a loading hopper locking mechanism adapted for more reliable long term operation in securely retaining the hopper in sealed relation to a front face of the laundry machine during laundering cycles.

A further object is to provide an improved sealing arrangement between the hopper unit and machine housing effective for preventing transmission of vibrations between the housing and hopper unit during extract cycles of operation.

Another object is to provide a commercial laundry machine having a removable loading hopper designed to minimize the need for water to facilitate direction of goods through the hopper into the laundry machine, and hence, eliminate the need for a liquid drainage cycle prior to a washing operation.

A further object is to provide a commercial laundry machine having a loading hopper which is less susceptible to the undesirable accumulation or build up of dirt and grime in the hopper after prolonged usage. A related object is to provide such a commercial laundry machine having a liquid spray arrangement adapted for more effectively maintaining the hopper in clean condition.

Other objects and advantages of the invention will become apparent upon reading the following detailed description and upon reference to the drawings, in which:

Figure 1:
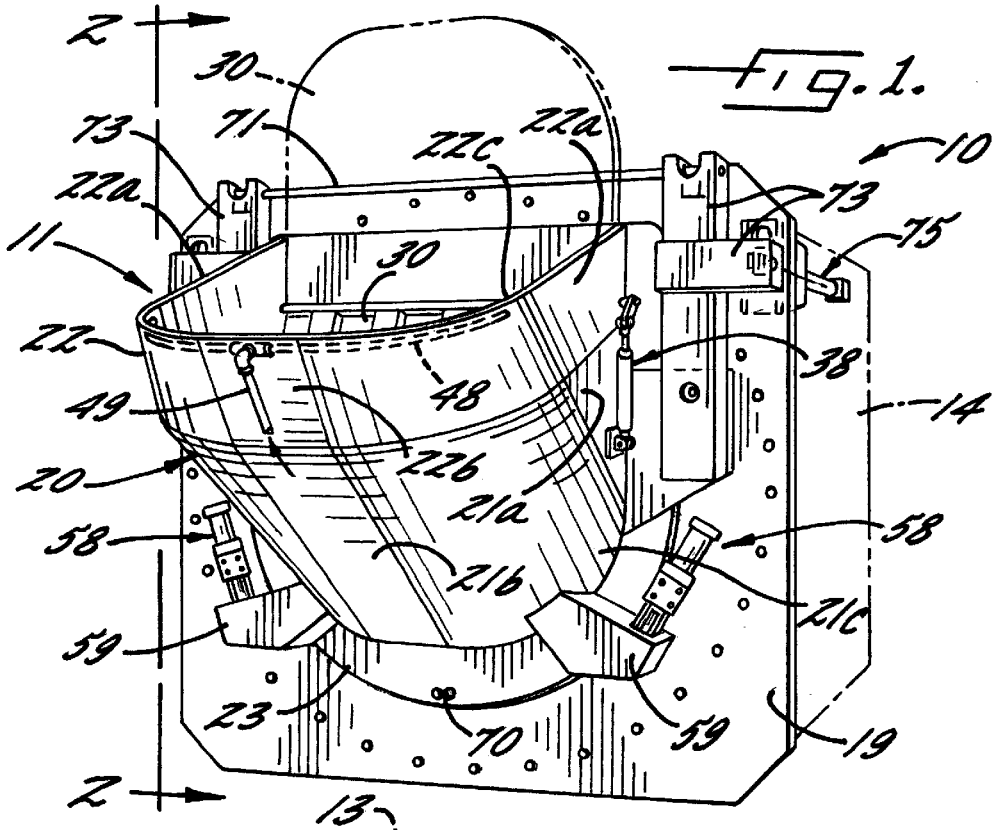
FIG. 1 is a front perspective of an illustrative commercial laundry machine having a loading hopper unit in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative commercial laundry machine 10 having a loading hopper unit 11 embodying the present invention. The laundry machine 10 includes a conventional drum 13 that is rotatably mounted within a machine housing 14 and has a front opening 15, through which launderable items are introduced into the drum 13 for laundering. As is known in the art, the housing 14 and drum 13 are adapted to be tilted relative to the horizontal between loading, laundering, and unloading positions. The illustrated laundry machine 10 further has inflatable bags 16 of a conventional type for supporting the machine in isolated relation to the floor during liquid extract cycles of operation when the machine is subjected to extensive vibrations.

For facilitating the direction and loading of launderable items released from an overhead sling 18 into the front opening 15 of the laundry machine drum 13, the hopper unit 11 is mounted on a front face 19 of the housing 14 in overlying relation to the front opening 15 of the drum 13.

The hopper unit 11 includes an upwardly opening chute or trough 20, in this case having an outwardly extending base plate 23 about its perimeter adapted for positioning in adjacent overlying relation to the front face 19 of the laundry machine housing 14.

Figure 2:
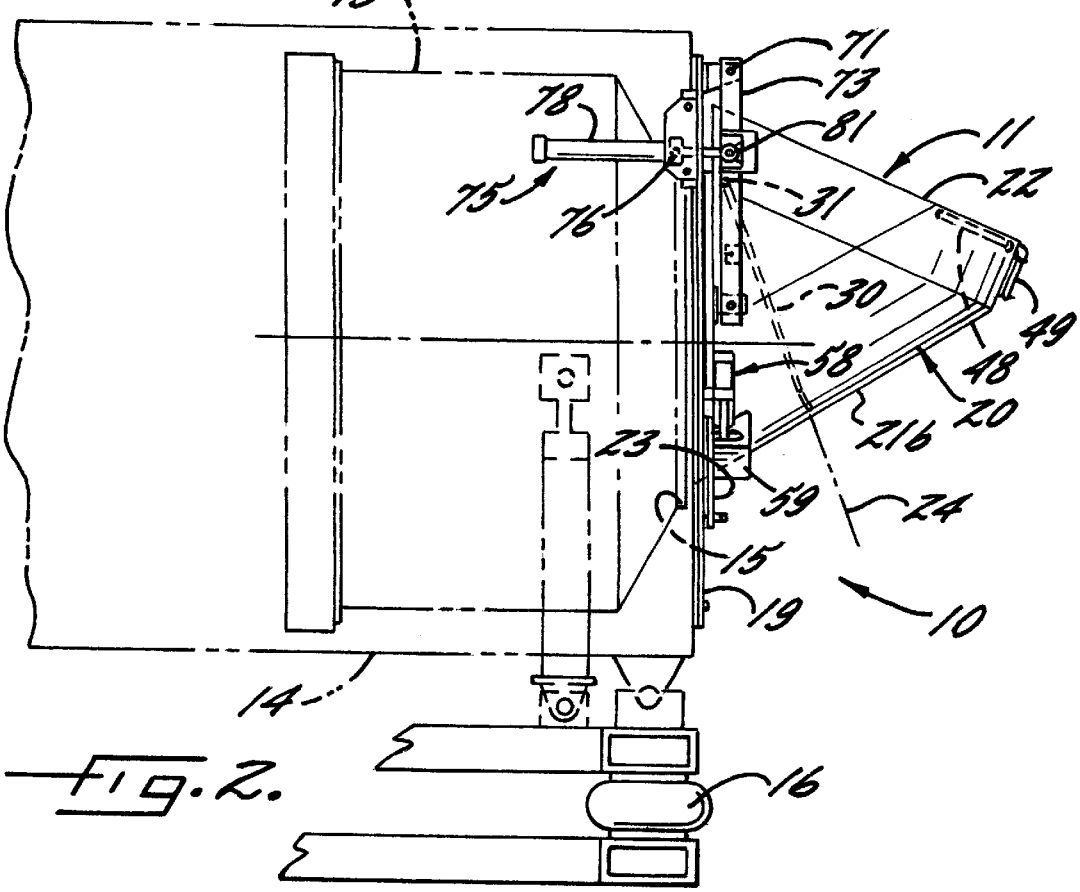
FIG. 2 is a partially diagrammatic side elevational view of the laundry machine and loading hopper unit shown in FIG. 1, taken in the plane of line 2—2.

In accordance with an important aspect of the invention, the hopper unit chute defines a relatively large passage to the front opening of the laundry machine drum so as to enable larger quantities of launderable items to be quickly and efficiently introduced into the laundry machine. To this end, the illustrated hopper unit chute 20 has a lower portion 21 formed with a horseshoe cross-sectional configuration defined by vertical planar side wall sections 21*a*, a planar bottom wall section 21*b*, and large radiused corner sections 21*c* interconnecting the side and bottom wall sections 21*a*, 21*b*. The comer sections 21*c* preferably have radii at least ⅓rd the diameter of the drum opening 15 so that the lower chute portion 21 has a generally rounded shape about the drum opening 15 when the hopper is positioned adjacent the front face 19 of the laundry machine housing 14, as depicted in FIG. 2. The bottom planar section 21*b* in this instance extends outwardly and upwardly from the front face 19 of the laundry machine housing at an angle of about 45 degrees.

The upper perimeter of the illustrated hopper chute 20 is defined by a relatively shorter depth flange portion 22 which extends in upwardly directed fashion from the lower chute portion 21. The chute flange portion 22 similarly has a horseshoe configuration defined by straight side wall sections 22*a*, a flat front section 22*b*, and large radiused corner sections 22*c*. The side sections 22*a* in this instance extend in co-planar relation to the side sections 21*a* of the lower chute portion 21 and the front section 22*b* is angled upwardly with respect to the bottom section 21*b*. As depicted in FIG. 2, the upper perimeter of the flange portion 22 is in a plane that angles downwardly at an angle of about 25 degrees to the horizontal when the laundry machine housing 14 is horizontally oriented with the hopper unit 11 positioned adjacent the front face 19 thereof.

Figures 7, 8, 9:
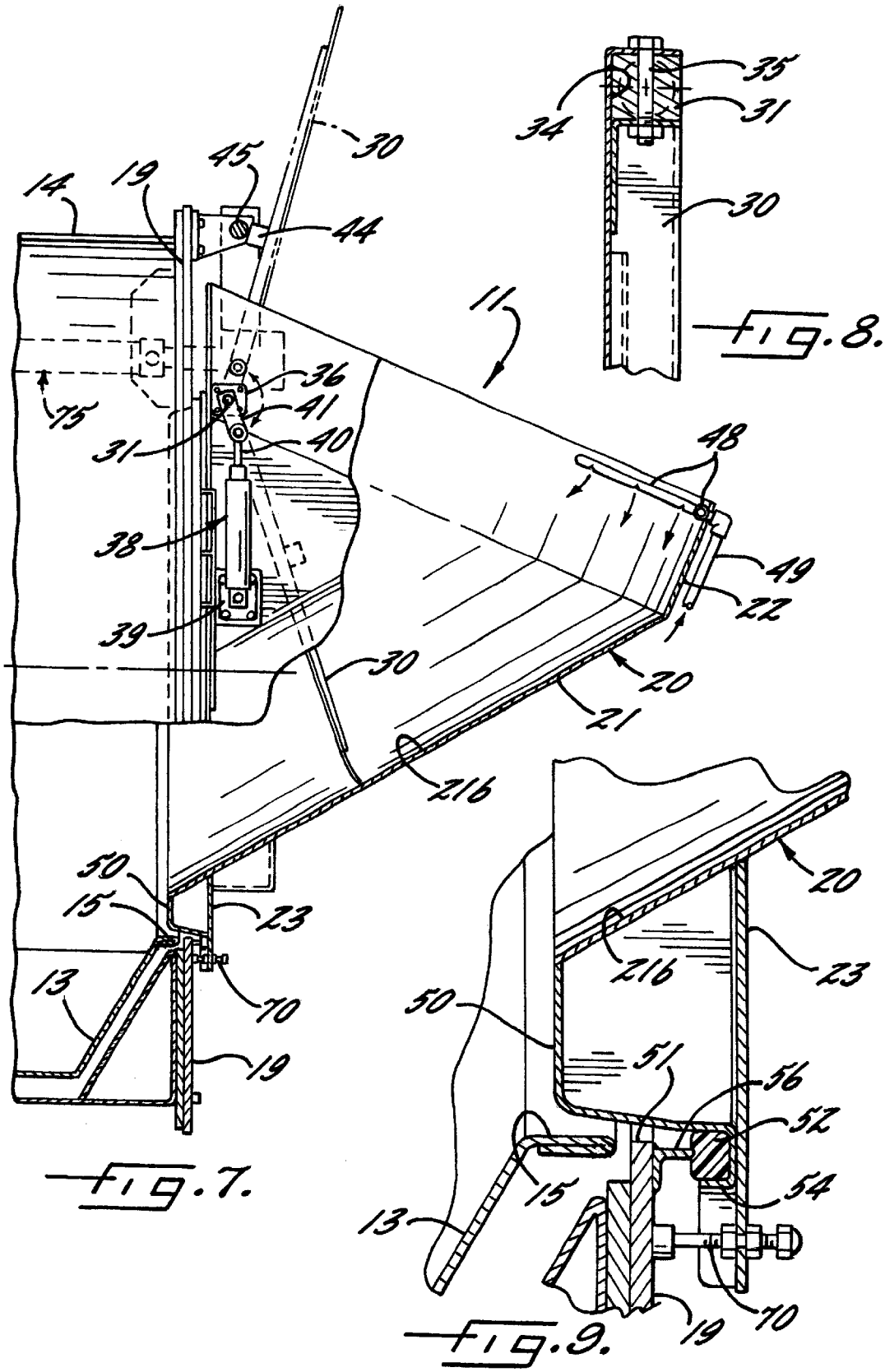
FIGS. 7 and 8 are enlarged fragmentary sections taken in the planes of lines 7—7 and 8—8, respectively, in FIG. 6.
FIG. 9 is an enlarged fragmentary section illustrating the sealing arrangement between the hopper unit and laundry machine housing.

The "effective passage area" of the hopper, i.e. herein meaning the smallest cross-sectional area through which launderable items can be directed through the hopper, in this case is in a plane 24 extending downwardly and outwardly of the front forward face 19 at an acute angle, such as about 30 degrees (FIG. 7). It will be understood by one skilled in the art that the effective passage area controls the quantity of goods that may be directed through the hopper at a given time.

Figure 13B:
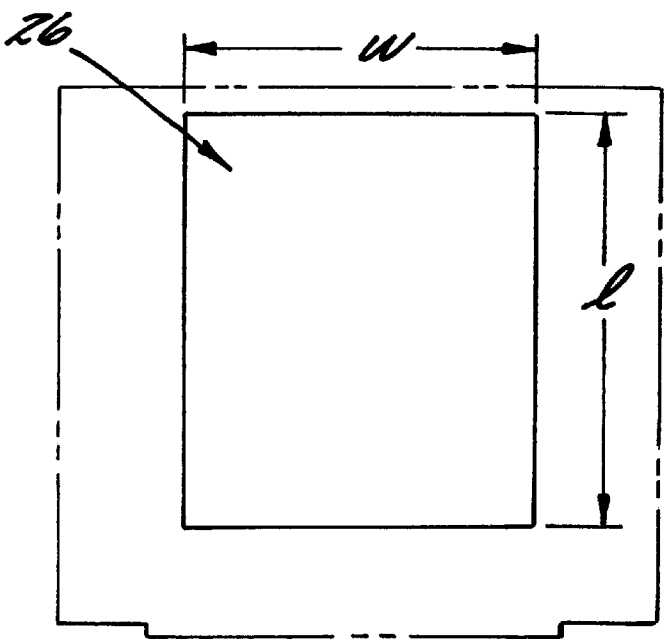
FIG. 13B is a diagrammatic depiction of the minimum effective passage area of a prior art hopper unit.
Figure 13A:
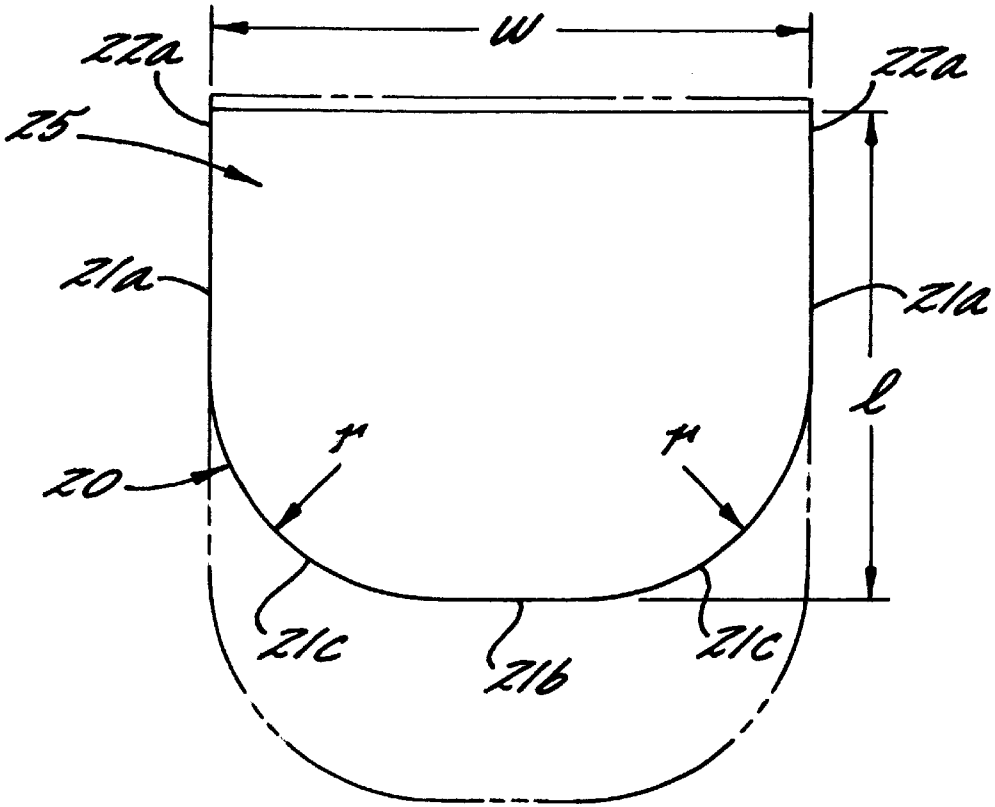
FIG. 13A is a diagrammatic depiction of the minimum effective passage area of the illustrated hopper unit.

In carrying out the invention, the hopper unit chute 20 has a relatively large effective passage area in relation to the front opening 15 of the laundry machine drum 13 for facilitating more efficient direction of launderable items into the drum 13 prior to a laundry cycle. In the illustrated embodiment, the chute 20 has an effective passage area 25 with a horseshoe cross-sectional configuration, as depicted in solid lines in FIG. 13A, which is significantly smaller than the perimeter of the hopper unit opening at the top of the chute, as diagrammatically depicted in phantom in FIG. 13A. The effective passage area 25 in this instance is defined by a section through the side sections 21*a*, 22*a*, corner sections 21*c*, and bottom section 21*b* of the chute 20. In a typical 800 pound capacity commercial laundry machine having a conventional drum with a 50 inch front opening 15, the effective passage area 25 is defined by sides having a length "l" of 38 inches, a width "w" of 47 inches, and corner sections 21*c* defined by a radius "r" of 18 inches. In such embodiment, the effective passage area 25 of the chute 20 is 11.43 sq. ft. versus a 13.63 sq. ft. area for the 50 inch drum opening 15. Hence, in such embodiment, the effective passage area 25 of the chute 20 is 83.9 percent of the area of the drum opening 50. Preferably, in achieving the advantages of the invention, the effective passage of chute 20 should be at least 75 percent of the area of the drum opening 15. In contrast, prior commercial laundry machines having hopper units constructed under the aforesaid '772 patent have been found to have effective passage areas of less than 50 percent of the drum opening. As depicted in FIG. 13B, the effective passage area 26 of such a hopper unit has a rectangular configuration, which in practice, has been found to be defined by sides "l" having a length of 32 inches and a width "w" of 27 inches. The resulting effective passage area 26 of 6 sq. ft. is 44 percent of the 13.63 sq. ft. area of a 50 inch conventional drum opening.

In practice, the large radiused corner sections 21*c*, 22*c* of the hopper unit chute 20 not only enhance the effective passage area of the hopper unit, but facilitate the direction of launderable items into and through the chute 20. More particularly, unlike the rectangular cross-sectional hoppers, typical of prior art, in which items tend to hang up in the corners of the hopper unit, the large radiused section corner sections 21*c*, 22*c* of the chute 20 direct items centrally into the chute 20 and into and through the drum opening 15. The radiused corner sections 21*c*, 22*c* further eliminates high stress concentrations and potential failures at the comers of the hopper unit, typical of rectangular configured hopper units, particularly during extract cycles when the hopper unit can incur severe vibrations.

In carrying out a further feature of the invention, the hopper unit 11 has a splash door 30 mounted on a horizontal pivot axis adjacent a front face of the laundry machine housing 14 and extending across the top of the chute 20 for movement between a lowered position that at least partially closes the upper end of the hopper and a raised, upwardly extending position that neither reduces the effective passage area 25 of the chute 20 nor impedes the introduction of launderable items into and through the chute. In the illustrated embodiment, the splash door 30 is mounted on a horizontal pivot shaft 31 which extends across the top of the chute 20 adjacent the base plate 23, which in turn is adjacent the front face 19 of the machine housing 14. In order to securely support the splash door 30, the pivot shaft 31 has a square cross section, as depicted in FIG. 8, mounted in a rearwardly opening channel 34 across the top of the splash door 30. Retaining bolts 35 secure the splash door 30 on the pivot shaft 31. Opposite axial ends of the pivot shaft 31 extend through side wall sections 22*a* of the chute 20 and are supported by bearings 36 secured to opposite sides of the chute 20.

For raising and lowering the splash door 30 between open and closed positions, a pair of double acting hydraulic cylinders 38 are mounted on opposite sides of the chute 20. The cylinders 38 each have a lower end pivotally mounted in a support bracket 39 fixed to a respective side of the chute 20 and a cylinder rod 40 pivotally connected to one end of a crank arm 41, the other end of which in fixed to the pivot shaft 31. It will be seen that actuation of the cylinders 38 will extend the cylinder rods 40 and pivot the crank arms 41, which in turn pivot the splash door 30 upwardly to an open position, as shown in phantom in FIG. 7. Reverse actuation of the cylinders 38 returns the splash door 30 to a lowered closed position.

The illustrated splash door 30 has a U-shape perimeter which when pivoted to the lowered closed position conforms with the inner perimeter of the horseshoe configured lower chute portion 21 to close communication through the chute 20 to the drum opening 15. As depicted in FIG. 7, in the closed position, the splash door 30 is oriented at an acute angle, such as 30 degrees, to the front face 19 of the machine and is in substantially perpendicular relation to the lower planar section 21*b* of the chute 20. An appropriate seal is provided about the perimeter of the splash door 30 for sealing engagement with the chute 20 when the splash door is in a closed position. In the raised position, as depicted in FIG. 7, the splash door extends upwardly nearly parallel to the plane of the front face 19 of the machine housing 14. A resilient bumper 44 in this instance is mounted on a rear side of the splash door 30 for engaging a stop 45 mounted in forwardly extending relation to the front face 19 of the machine housing 14 for limiting upward movement of the splash door 30 to a predetermined raised position.

Figure 3:
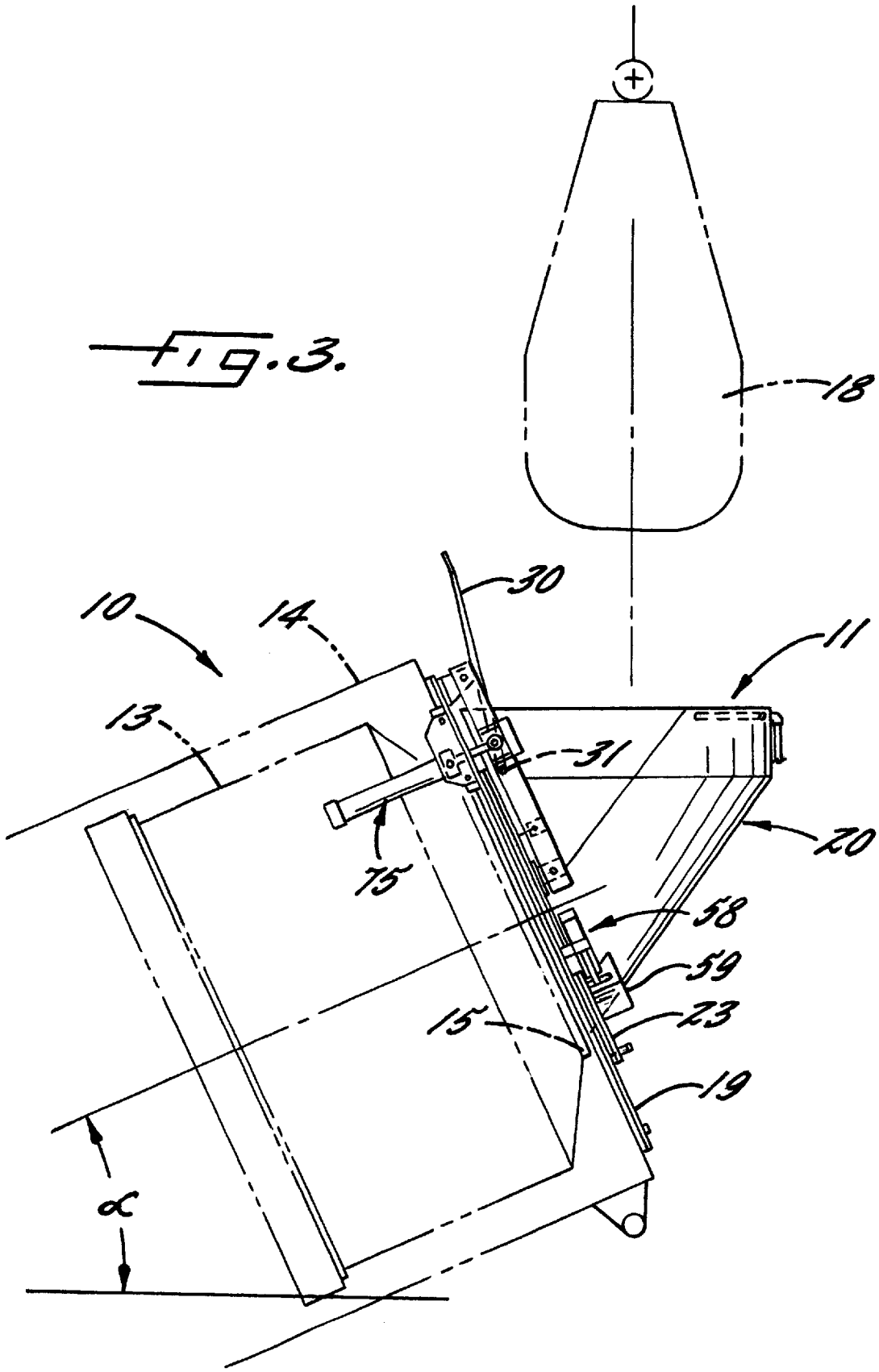
FIG. 3 is a partially diagrammatic view of the laundry machine and loading hopper unit in a loading position below a sling of launderable items.
Figure 4:
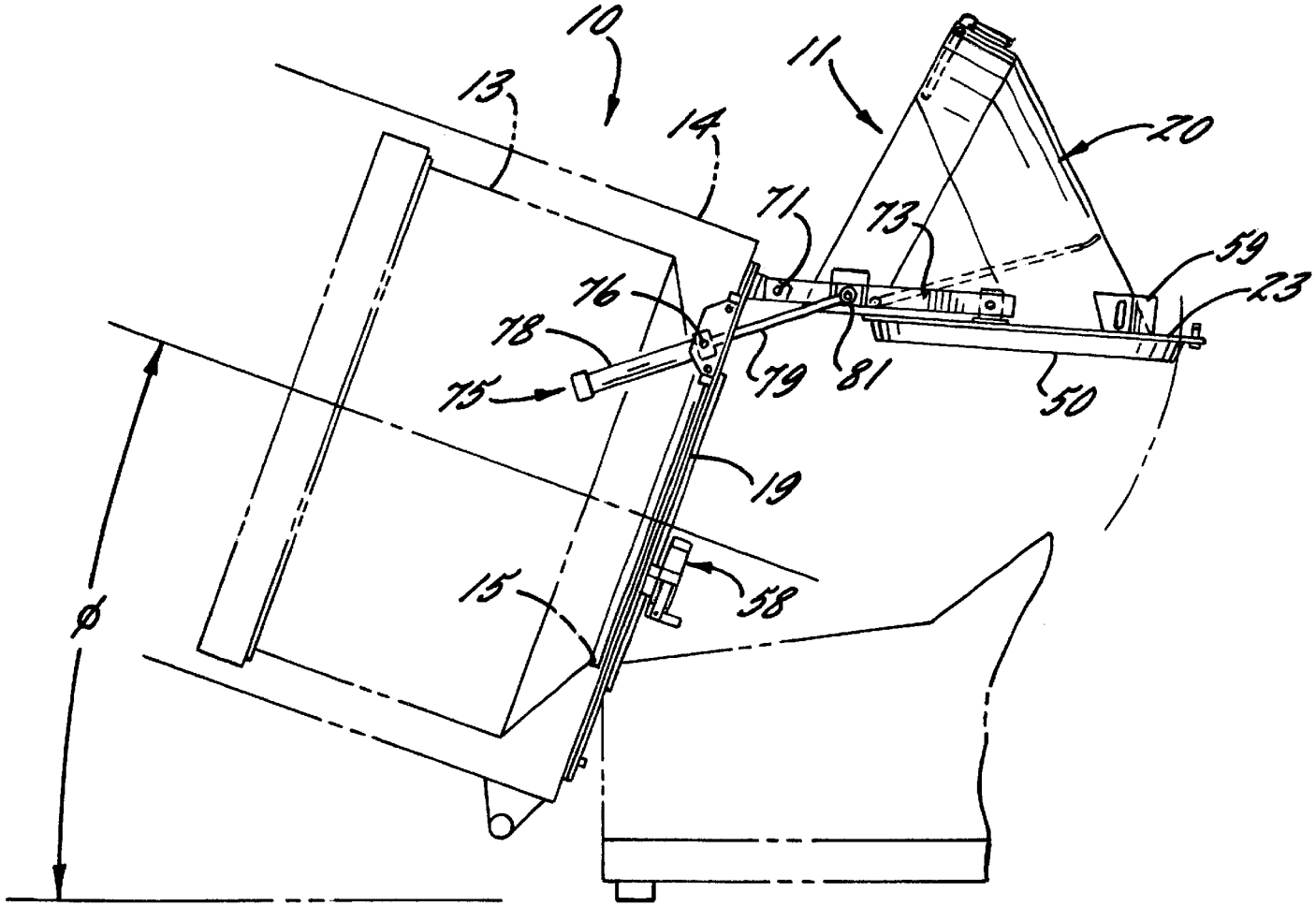
FIG. 4 is a partially diagrammatic view of the laundry machine and loading hopper unit in an unloading position.

When the laundry machine housing 14 and drum 13 are tilted upwardly and the splash door 30 is raised for a loading cycle, as shown in FIG. 3, the upper perimeter of the chute is in a substantially horizontal plane with the splash door 30 angled rearwardly with respect to a vertical drop line of items from the sling 18. It can be seen that in such open position the splash door 30 neither limits or restricts the effective passage 25 of the hopper unit, but rather, serves as an upstanding guide for directing items centrally into the hopper unit. With the splash door 30 in such upwardly and rearwardly extending relation relative to the drop direction from an overhead sling, launderable items also will not become hung up on the splash door, typical of the prior art, requiring excessive forces to rotate the splash door to a closed position. With the pivot shaft 31 of the splash door 30 located adjacent the top of the hopper unit, it also is less likely to be exposed to water and chemicals which can create films that impede long term reliable operation.

In practice, it has been found that the relatively large effective passage area 25 of the hopper unit chute 20, combined with the upwardly raised splash door 30 that assists in directing launderable items into the hopper unit, enables significantly larger quantities of launderable items to be simultaneously introduced into the machine drum 13 than heretofore possible. While 200 pound slings are conventionally used for loading commercial laundry machines, a laundry machine with a hopper unit 11 in accordance with the present invention is adapted for receiving goods from slings twice that size, i.e. 400 pounds, thereby reducing the number of slings that must be handled and loaded into the laundry machine by 50 percent. While six 200 pound slings typically can be required for loading a conventional commercial laundry machine, a laundry machine 10 with the hopper unit 11 may be loaded with three slings, reducing the typical loading time from about 18 minutes to about nine minutes. Depending upon the particular wash and extract cycles, the reduced loading time alone can improve laundry machine productivity by 24 to 32 percent.

In keeping with a further aspect of the invention, the hopper unit 11 includes a liquid spray arrangement that is operable with lesser liquid requirements for maintaining the chute 20 in a clean condition and providing required lubricity for enhanced passage of items through the chute. In the illustrated embodiment, a U-shaped liquid supply line 48 is mounted along the inside of the chute 20 adjacent the upper end of the front and corner sections 22*a*, 22*c*, which is supplied with liquid from a central supply line 49 and is formed with a plurality of discharge orifices for directing liquid down the front sections and corner sections of the chute 20. Since water need not be sprayed about the splash door, typical of the prior art, to the extent a liquid spray is used to improve lubricity of the hopper chute 20 significantly lesser quantities of water are required. Since the splash door 30 is raised from the chute 20 during both cleaning and unloading, liquid may be applied directly to the chute for more effective and efficient usage. The substantially shorter loading time further minimizes liquid usage, and eliminates the need for a liquid drain cycle prior to the start up of a laundry operation.

In keeping with a further feature of the invention, the laundry machine has an improved locking and sealing arrangement for securely maintaining the hopper unit in closed position during laundering cycles, as well as during extract cycles when the hopper unit can be exposed to significant vibratory forces. In the illustrated embodiment, an inlet end of the chute 20 is defined by an outer peripheral spinning 50 which is mounted rearwardly of the base plate 23 and protrudes inwardly through a front opening 51 in the front face 19 of the machine housing 14, as depicted in FIGS. 7 and 9, for communication with the front opening 15 of the drum 13 when the chute 20 is in a lowered position. A seal 52 is retained about the perimeter of the spinning 50 in rearwardly projecting relation to the hopper base plate 23 and is secured thereto by a rearwardly facing U-shaped end 54 of the spinning 50. When the hopper unit 11 is in a lowered or operative position, as shown in FIGS. 7 and 9, the seal 52 engages a sealing flange 56 mounted in forwardly extending relation to the front face 23 of the machine housing 14.

Figure 10:
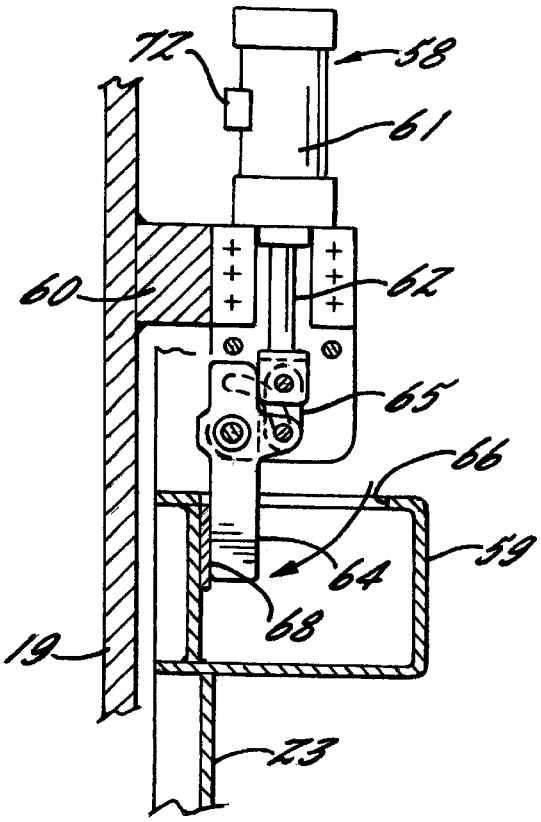
FIG. 10 is an enlarged fragmentary section of a hopper unit locking device taken in the plane of line 10—10 in FIG. 6, showing the device in a locking position.

For forcing the chute 20 and the seal 52 carried thereby against the housing sealing flange 56 to create a water tight seal between the hopper unit and machine housing, pneumatic toggle switches 58 are provided for cooperation with respective latch boxes 59 mounted in outwardly extended relation to the hopper unit base plate 23. In this case, the hopper unit 11 has a pair of latch boxes 59 extending radially outwardly from opposite lower sides of the base plate 23, which each are engageable by a respective toggle switch 58 mounted on the front face 19 of the laundry machine housing 14. The toggle switches 58, which may be a commercial type sold under the trademark Testaco, each are mounted on a support plate 60 fixed in forwardly extending relation to the front face 19 of the housing 14 (see FIG. 10). The toggle switches 58 each include a cylinder body 61 having a downwardly extending piston rod 62 connected to a locking arm 64 through an overcenter connecting link 65. Actuation of the cylinders 58 will extend the cylinder rods 61 and pivot the lock arms 64 downwardly through an opening 66 in the latch box 59 and into engagement with a strike plate 68, as depicted in FIG. 10, urging the hopper unit 11 toward the front face 19 of the machine housing 14 with the seal 52 engaging the housing sealing flange 56. For preventing overcompression of the hopper unit seal 52, an adjusting screw 70 is mounted in rearwardly extending relation to the hopper unit base plate 23 for engagement with the front face 19 of the housing 14. Selected positioning of the adjusting screws 70 relative to the hopper base plate 23 enables the establishment of a desired sealing pressure.

Figure 11:
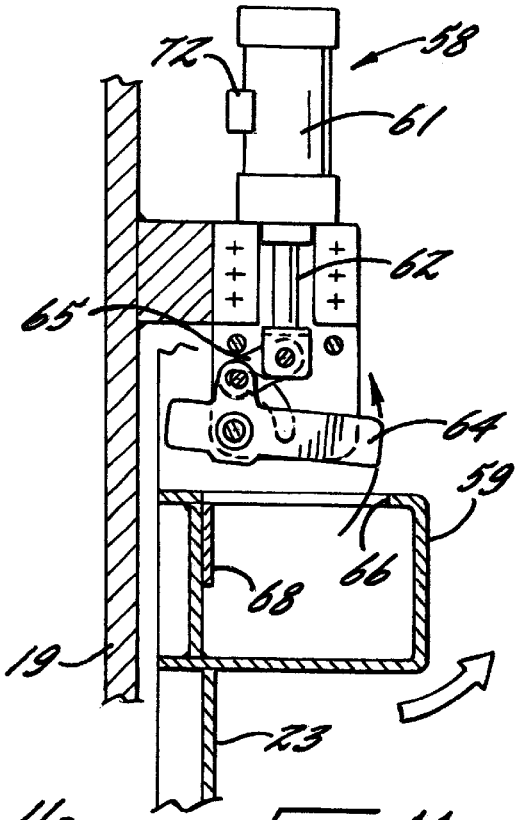
FIG. 11 is a fragmentary section, similar to FIG. 10, showing the locking device in an unlocked position.

As shown in FIG. 11, reverse actuation of the toggle switches 58 and retraction of the piston rods 62 will pivot the toggle switch locking arms 64 outwardly of the respective hopper latch boxes 59 for enabling movement of the hopper unit 11 away from the front face 19 of the laundry machine housing 14, as will become apparent. For monitoring the locked condition of the hopper unit 11, each cylinder 58 has a respective read switch 72 mounted thereon for sensing the position of the cylinder rod 62. It will be appreciated by one skilled in the art that since the desired sealing pressure between the hopper unit 11 and machine housing 14 can be maintained by the combined effect of the adjusting screws 70 and the toggle switches 58, the locking arrangement is less susceptible to wear and looseness typical of prior art hopper locking devices after prolonged usage under severe vibratory conditions. The read switches 72 further are adapted for long term reliable operation.

Figure 9A:
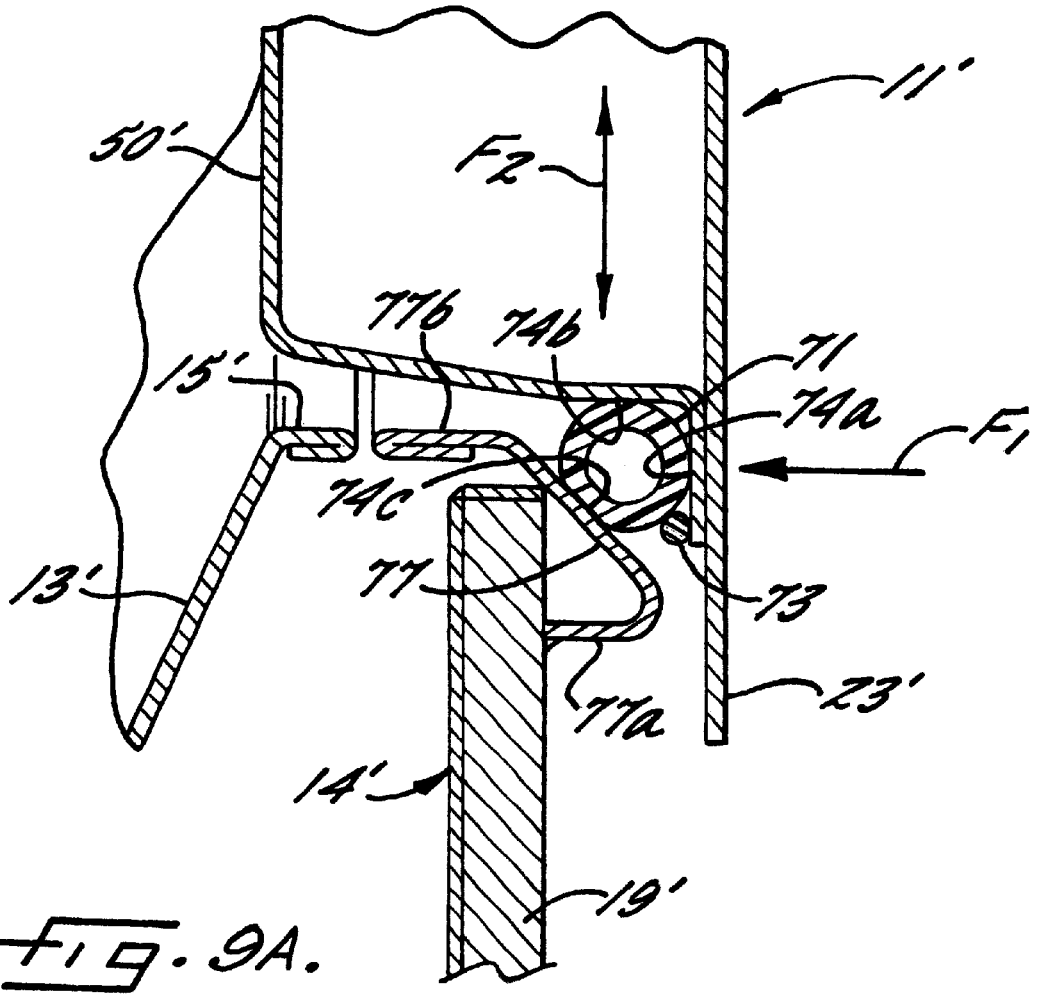
FIG. 9A is an enlarged fragmentary section illustrating an alternative sealing arrangement between the hopper unit and laundry machine housing adapted for more effectively preventing the transmission of vibration between the machine housing and hopper unit during extract cycles of operation.

In accordance with still a further aspect of the invention, an alternative sealing arrangement is provided between the hopper unit and housing for more effectively preventing the transmission of vibrations between the machine housing and the hopper unit during extract cycles of operation. With particular reference to FIG. 9A, wherein items similar to those described above have been given similar reference numerals with a distinguishing prime, i.e. "'" added, a seal 71 is provided which is adapted for three directional sealing and shock absorption between the hopper unit 11' and housing 14' when the hopper unit 11' is in a closed position. The seal 71 preferably has an elongated hollow tubular shape, and like the seal 52 described above, is disposed on a rearward side of the hopper unit base plate 23' in surrounding relation to an outer perimeter of a spinning 50'. The seal 71 preferably is mounted in a stretched condition about the hopper unit 11' so as to be biased or urged into retained engagement with a corner of the hopper unit defined by the rear side of the base plate 23' and an outer perimeter of the spinning 50'. A rod-like retaining member 73 is disposed on a side of the seal 71 opposite the spinning 50' for further locating and retaining the seal in mounted position.

In carrying out this embodiment of the invention, the hopper unit 11' and housing 14' define three seal-engaging surfaces each oriented at an angle with respect to each other when the hopper unit is in a lowered closed position. A first sealing surface 74*a* is defined by the rear side of the hopper unit base plate 23', and more particularly, in this instance by the rear side of a radial flange of the spinning 50', the second sealing surface 74*b* is defined by an outer annular side of the spinning 50' which in the illustrated embodiment extends in generally perpendicular relation to the first sealing surface 74*a* and a third sealing surface 74*c* is defined by an angled sealing plate 77 mounted on the machine housing 14' and in rearwardly and inwardly extending relation thereto. The angled sealing plate 77 in this case is defined by one leg of a V-shaped retaining plate which has an opposite leg 77*a* affixed, such as by weldment, in forwardly extending relation to the front face 19" of the housing. The inclined sealing plate 77 in this case extends rearwardly and radially inwardly at an angle of about 45° to the front face 19' of the housing and the first and second sealing surfaces 74*a*, 74*b* and has a terminal end portion 77*b* that extends rearwardly to define the front housing opening.

It will be seen that when the hopper unit 11' is forced into closed and sealed engagement with the annular seal 71, such as by the locking unit described above, an inwardly directed clamping pressure or force F1 is exerted against the sealing member 77 by the sealing surface 74*a* in a direction parallel to the axis of the drum and the housing opening and a lateral pressure or force F2 is exerted by the sealing surface 74*b* against the sealing member 71 in a direction perpendicular to the force F1. These forces are resisted and countered by the inclined sealing plate 77 when the hopper unit 11' is in a closed position with the tubular sealing member 71 interposed between the three angled sealing surfaces, 74*a*, 74*b*, 74*c*. It will be seen that the tubular sealing member 71 not only provides three point sealing contact between the hopper unit 11' and the housing 14' but tends to dampen and prevent transmission of vibrational forces from the machine housing 14 to the hopper unit 11' in both axial and radial directions, which can be significant during extract cycles of operation. It has been found that the tubular sealing member 71, combined with such three point sealing engagement, more effectively prevents the transmission of vibrations from the housing to the hopper unit, which can otherwise cause damage and breakage to the relatively massive overhung hopper unit and its mounting.

Figure 5:
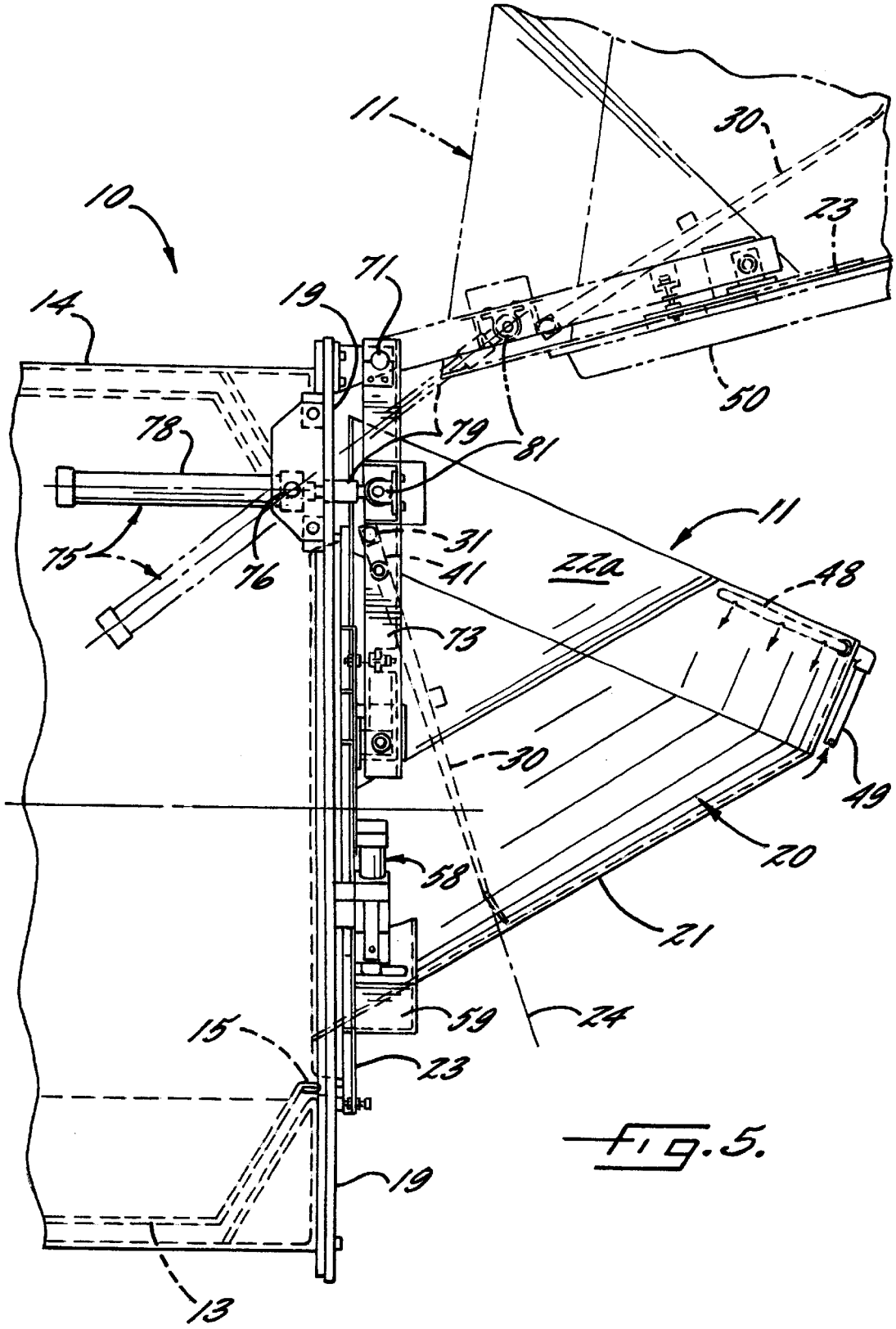
FIG. 5 is an enlarged fragmentary side elevational view of the laundry machine and hopper unit, showing movement of the loading hopper unit between a position adjacent a front end of the laundry machine and a raised unloading position.
Figure 6:
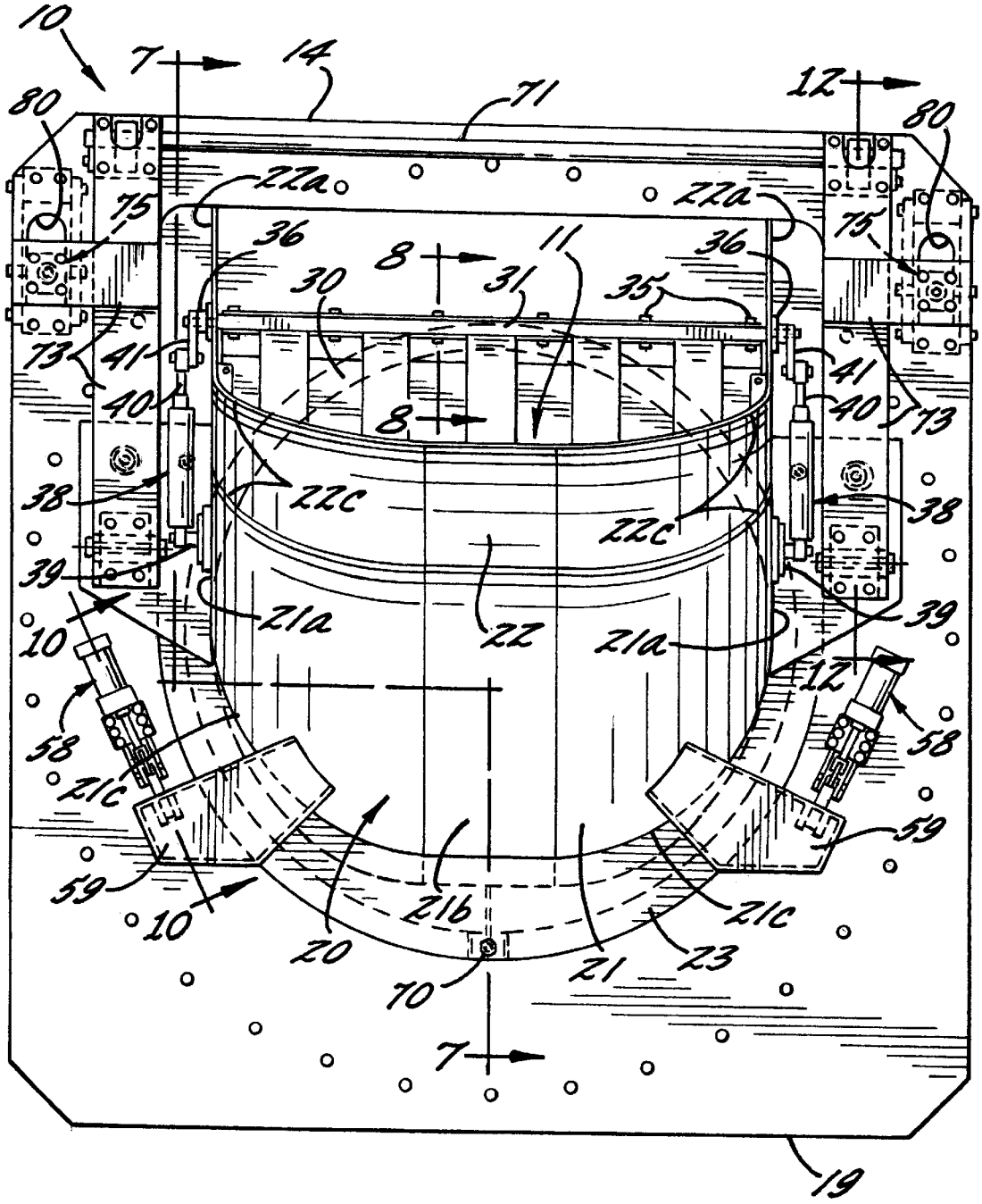
FIG. 6 is an front elevational view of the illustrative laundry machine and loading hopper unit.
Figure 12:
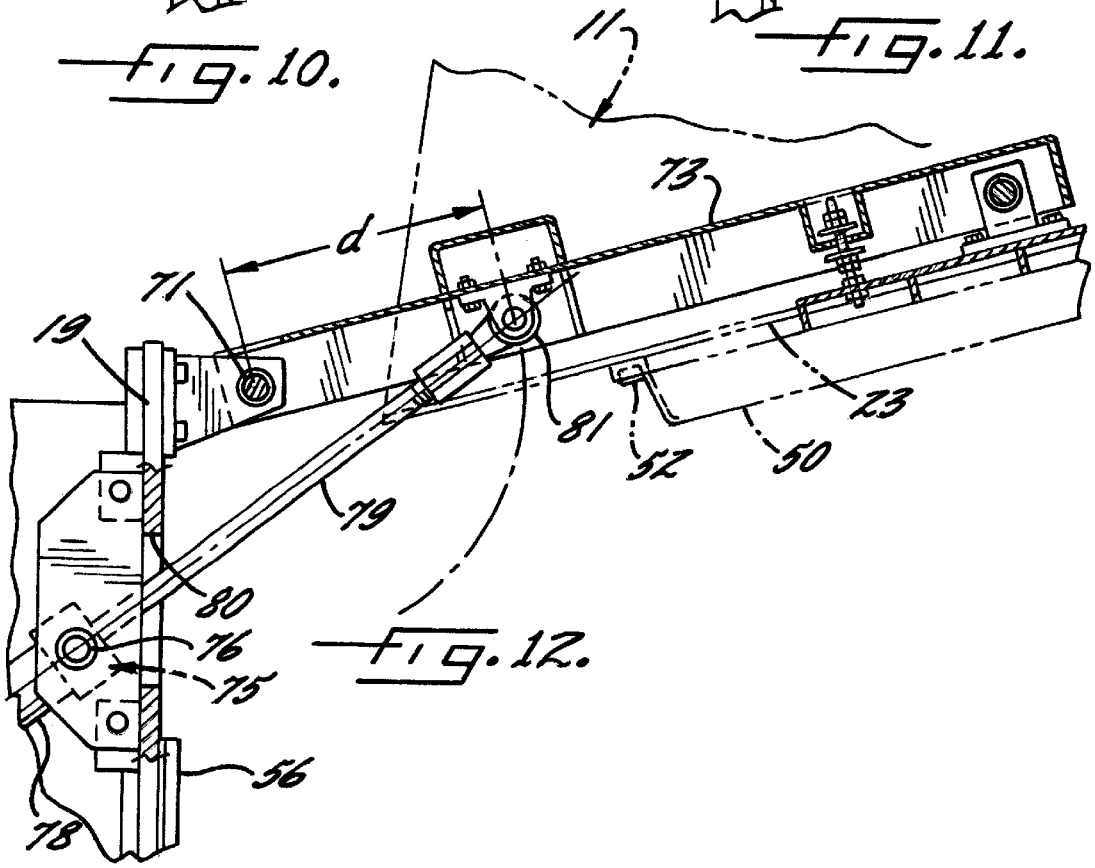
FIG. 12 is an enlarged fragmentary section, taken in the plane of line 12—12 in FIG. 6, showing the hopper unit being raised to an unloading position.

In carrying out yet another feature of the invention, hydraulic cylinders 75 having forward trunnion mountings are provided for pivoting and lifting the hopper unit 11 through an arc of at least about 90 degrees between a lowered operative position adjacent the front face 19 of the machine and a pivotally raised position for enabling unloading of the laundry machine following a laundry cycle without interference from the hopper unit 11. In the illustrated embodiment, hydraulic cylinders 75, which may be of a conventional type, are mounted on opposite sides of the machine housing 14 a relatively short distance below the hopper unit pivot shaft 71 (FIGS. 5 and 6). The hydraulic cylinders 75 each have a cylinder body 78 mounted at a forward end for relative pivotal movement by a respective trunnion 76 extending outwardly from a side of the laundry machine housing. The hydraulic cylinders 75 in this case each have a forwardly extending cylinder rod 79 extending through a respective slot 80 in the front face 19 of the machine housing 14 with an outer end pivotally connected to the hopper by a respective bearing 81 fixed to an extending bracket member 73 mounted to the hopper base plate 23 With the hopper unit 11 in its operative position adjacent the front face 19 of the machine housing 14, as seen in FIG. 2, it will be seen that the hydraulic cylinders 75 extend rearwardly in substantial parallel relation to the horizontal axis of the machine. Actuation of the hydraulic cylinders 75 will extend the cylinder rods 79 pivoting the hopper unit 11 outwardly and upwardly from the front face 19 of the laundry machine, with the hydraulic cylinders 75 simultaneously pivoting downwardly. It will be appreciated that the front trunnion mounting of the hydraulic cylinders 75 enables the hopper unit 11 to be pivoted upwardly through an angle greater than 90 degrees, while the hydraulic cylinders 75 pivot through an acute angle only slightly greater than 45 degrees. Hence, the front trunnion mounting of the hydraulic cylinders 75 enables the hopper to be pivoted a wider angle for facilitating unloading of laundered items without interference from the hopper unit 11, while at the same time occupying a relatively small space adjacent the upper sides of the hopper unit so as not to interfere with loading conveyors or other access to the laundry machine. It will further be appreciated by one skilled in the art that the hydraulic cylinders 75 are operable for reliably pivoting and lifting the relatively massive hopper 11 even though the pivot arm "d" (FIG. 12) is relatively small in relation to the depth of the hopper. In the illustrative embodiment, the pivot arm "d" is less than ⅕th of the total depth of the hopper. The use of hydraulic cylinders also is effective for reliably actuating the hopper without instabilities typical of conventional pneumatic cylinders.

In operation of the laundry machine 10, it can be seen that with the hopper unit 11 positioned in sealed relation to the front face 19 of the laundry machine housing 14 with the toggle switches 58 securing the hopper unit 11 in place through actuation of the pneumatic cylinders 61, the laundry machine housing 14 and drum 13 may be tilted upwardly, as shown in FIG. 3, and the splash door 30 pivoted to an upwardly and rearwardly extended position through actuation of the hydraulic cylinders 38. Upon release of goods from an overhead sling 18 the goods will be directed centrally into the hopper chute 20 under the guidance of its horseshoe configuration and the upwardly and rearwardly extending splash door 30. Direction of goods through the hopper unit chute 20 and into the laundry machine drum 13 further can be facilitated by the discharge of liquid from the liquid supply line 48 about the upper end perimeter of the chute 20. Since launderable items introduced into the chute 20 need not pass over the splash door 30, minimum water or liquid is required to maintain the lubricity of the chute and to maintain the chute in a clean condition. Moreover, by virtue of the relatively large effective passage area 25 of the chute 20, commercial laundry machines may be loaded with no more than three 400 pound slings, thereby significantly shortening the normal loading time and further reducing the liquid spray requirement.

With the laundry machine loaded with launderable items, the splash door 30 maybe closed through reverse actuation of the hydraulic cylinders 38 and the laundry machine housing 14 and drum 13 tilted to a horizontal position for carrying out the laundry cycle in a conventional manner. As is known in the art, during the extract cycle, the bags 16 may be inflated to minimize the transmission of vibratory forces from the laundry machine to the floor. By virtue of the hydraulic cylinders 38 and 75 for the splash door 30 and hopper unit 11 and the toggle actuated hopper unit locking devices, the hopper unit 11 and splash door 30 are reliably maintained in closed and sealed conditions during laundry cycles, notwithstanding extensive vibrations. The horseshoe configuration of the hopper unit chute 20, and particularly the large radiused side sections 21*c*, 22*c* thereof, also withstand such vibrations without creation of high stress concentrations. Following completion of the laundry cycle, the hopper unit 11 is pivotally raised through an angle greater than 90 degrees upon actuation of the hydraulic cylinders 75 and the laundry machine housing 14 is tilted downwardly to permit unloading of laundered items in a conventional manner without interference from the hopper unit.

From the foregoing, it can be seen that the commercial laundry machine of the present invention has a loading hopper designed to substantially reduce loading time, and hence, substantially improve operating efficiency of the laundry machine. The hopper unit chute has a substantially larger effective passage area which, in combination with a splash door that is pivotal upwardly and away from the chute to assist in guiding items into the chute, enables substantially larger loading slings to be used with the laundry machine. The hopper unit locking and sealing arrangement also is adapted for long term reliable usage, and the trunnion mounted hopper unit actuating cylinders are effective for pivoting the hopper through a wider opening angle for enabling unloading of the washing machine without interference from the hopper.

What is claimed is:

1. A laundry machine comprising:

a housing, a drum rotatably mounted within said housing and having a front opening through which launderable items may be introduced and withdrawn said housing and drum being tiltable between a horizontal operating position and a loading position with the drum opening tilted upwardly and an unloading position with the drum opening tilted downwardly, a hopper unit having a chute that defines a passage, a hopper unit actuating device for moving said hopper unit between a first position adjacent a front face of said housing wherein said chute passage communicates with said drum opening such that launderable items deposited into said chute are directed into said drum through said front opening during a loading cycle and a second position in which said chute is located remote from said drum opening to permit removal of launderable items through said drum open during an unloading cycle, said hopper unit including a splash door that is movable between an opened position for permitting passage of items through said chute passage into said drum opening when said hopper unit in said first position and a closed position in which said splash door at least partially closes said chute passage, a splash door actuating device for moving said splash door between said opened and closed positions, and said chute having an effective passage area defined by the smallest cross-sectional area of said chute passage through which launderable items can be directed which is at least 75 percent of the area of said drum opening.

2. The laundry machine of claim 1 in which said chute has an effective passage area which is greater than 80 percent of the area of the drum opening.

3. The laundry machine of claim 1 in which said chute has a horseshoe cross-sectional configuration defined by planar side wall sections, a planar bottom wall section, and radiused corner sections interconnecting said side and bottom wall sections.

4. The laundry machine of claim 3 in which said corner sections are defined by a radius that is at least one third the diameter of the drum opening.

5. The laundry machine of claim 4 in which the bottom wall section of the chute extends outwardly and upwardly from the front face of the laundry machine at an angle of about 45 degrees when said hopper unit is in said first position.

6. The laundry machine of claim 4 in which said chute has an upper flange portion of horseshoe configuration defined by straight side wall sections, a flat front section, and radiused corner sections, and said front section of said upper flange portion is angled upwardly with respect to said bottom section.

7. The laundry machine of claim 1 in which said chute has an upper perimeter that is in a substantially horizontal plane when said hopper unit is in said first position.

8. The laundry machine of claim 1 in which the effective passage area of said chute is in a plane that angles downwardly and outwardly from the front face of said housing at an angle of about 30 degrees when said hopper unit is in said first position.

9. The laundry machine of claim 1 in which said splash door is mounted for movement about a horizontal pivot axis located adjacent a front face of said laundry machine and extending across the top of said chute for pivotal movement between a lowered position closing said chute passage and a raised position extending upwardly from said chute for opening the chute passage for communication with said drum opening.

10. The laundry machine of claim 1 in which said hopper unit is mounted for pivotal movement about a horizontal pivot axis adjacent a front face of said machine housing and extending across a top of the hopper unit, said hopper unit actuating device including a pair of hydraulic cylinders mounted rearwardly of the hopper unit, said hydraulic cylinders each including a cylinder body and a forwardly extending cylinder rod pivotally connected to said hopper unit at a location below the pivot axis thereof, and trunnions mounted in fixed relation to the hopper unit each for supporting a forward end of a respective cylinder body with the cylinder body extending rearwardly of the trunnion, and said hydraulic cylinders being actuatable to extend said cylinder rods to pivot the hopper unit about said pivot axis between said first and second positions.

11. A laundry machine comprising:

a housing, a drum rotatably mounted within said housing and having a front opening through which launderable items may be introduced and withdrawn, said housing and drum being tiltable between a horizontal operating position and a loading position with the drum opening tilted upwardly and an unloading position with the drum opening tilted downwardly, a hopper unit having a chute that defines a passage, an actuating device for moving said hopper unit between a first position adjacent a front face of said housing wherein said chute passage communicates with said drum opening such that launderable items deposited into said chute are directed into said drum through said front opening during a loading cycle and a second position in which said chute is located remote from said drum opening to permit removal of launderable items through said drum opening during an unloading cycle, said hopper unit including a selectively openable splash door, said splash door having a horizontal pivot axis extending across said chute adjacent a top side thereof, and a splash door actuating device for pivoting said splash door about said pivot axis between a lowered position at least partially closing communication of said chute passage with said drum opening and an upwardly extending raised position permitting communication of said chute passage with said drum opening.

12. The laundry machine of claim 11 in which said splash door is mounted a t its upper end on a pivot shaft.

13. The laundry machine of claim 12 in which said pivot shaft has a rectangular cross section.

14. The laundry machine of claim 12 in which said splash door actuating device includes a pair of hydraulic cylinders mounted on opposite sides of said chute, said cylinders each having a respective cylinder rod operatively connected to an end of the splash door pivot shaft for rotating the pivot shaft and the splash door mounted thereon in response to actuation of the cylinders and movement of said cylinder rods.

15. The laundry machine of claim 11 in which said splash door extends downwardly and outwardly at an acute angle to the front face of said machine housing when the splash door is in a lowered position and said hopper unit is in said first position.

16. The laundry machine of claim 11 in which said chute has a U-shaped cross-sectional shape and said splash door has a U-shaped cross-sectional shape which conforms to the shape of said chute when said splash door is in said lowered position.

17. The laundry machine of claim 16 in Which said liquid supply includes a U-shaped liquid supply line mounted about the upper periphery of said chute for directing liquid into said chute when said splash door is in a raised position.

18. The laundry machine of claim 11 including a liquid supply disposed about the upper periphery of said chute for directing liquid into said chute when said splash door is in a raised open position.

19. A laundry machine comprising:

a housing, a drum rotatably mounted within said housing and having a front opening through which launderable items may be introduced and withdrawn said housing and drum being tiltable between a horizontal operating position and a loading position with the drum opening tilted upwardly and an unloading position with the drum opening tilted downwardly, a hopper unit having a chute that defines a passage, an actuating device for moving said hopper unit between a first position adjacent a front face of said housing wherein said chute passage communicates with said drum opening through a rear opening of said chute such that launderable items deposited into said chute are directed into said drum through said front opening during a loading cycle and a second position in which said chute is located remote from said drum opening to permit removal of launderable items through said drum opening during an unloading cycle, said hopper unit including a splash door that is movable between a raised open position for permitting passage of items through said chute passage into said drum opening when said hopper unit in said first position and a lowered closed position in which said splash door at least partially closes said chute passage, said splash door having a horizontal pivot axis extending across said chute at a location adjacent a top side of said rear chute opening for enabling movement of said splash door between said open and closed positions, and a splash door actuating device for moving said splash door between said open and closed positions.

20. The laundry machine of claim 19 in which said splash door actuating device pivots said splash door through an angle greater than 90 degrees during movement between said lowered and raised positions.

21. The laundry machine of claim 19 in which said splash door has a shape that conforms to the internal shape of said chute when said splash door is in said lowered closed position.

22. The laundry machine of claim 19 in which said chute has a horseshoe cross-sectional configuration defined by planar side wall sections, a planar bottom wall section, and radiused corner sections interconnecting said side and bottom wall sections; said corner sections being defined by a radius that is at least one third the diameter of the drum opening, and said chute having an effective area of at least 75 percent of the area of said drum opening.

23. A laundry machine comprising:

a house a drum rotatably mounted within said housing and having a front opening through which launderable items may be introduced and withdrawn, said housing and drum being tiltable between a horizontal operating position and a loading position with the drum opening tilted upwardly and an unloading position with the drum opening tilted downwardly, a hopper unit having a chute that defines a passage, said hopper unit being mounted for pivotal movement about a horizontal pivot axis extending across a top of said hopper unit, an actuating device for pivoting said hopper unit between a first position adjacent a front face of said housing wherein said chute passage communicates with said drum opening such that launderable items deposited into said chute are directed into said drum through said front opening during a loading cycle and a second position in which said chute is pivoted to a location away from said drum opening to permit removal of launderable items through said drum opening during an unloading cycle, said hopper unit including a splash door that is movable between an opened position for permitting passage of items through said chute passage into said drum opening when said hopper unit in said first position and a closed position in which said splash door at least partially closes said chute passage, a splash door actuating device for moving said splash door between said opened and closed positions, and said hopper unit actuating device including a pair of hydraulic cylinders mounted rearwardly of the hopper unit, said hydraulic cylinders each including a cylinder body and a forwardly extending cylinder rod pivotally connected to said hopper unit at a location below the pivot axis thereof, and trunnions mounted in fixed relation to the hopper unit each for supporting a forward end a respective cylinder body with the cylinder body extending rearwardly of the trunnion, and said hydraulic cylinders being actuatable to extend said cylinder rods to pivot the hopper unit about pivot axis between said first and second positions.

24. The laundry machine of claim 23 in which said hydraulic cylinders extend rearwardly of the hopper unit in substantially parallel relation to a horizontal axis of said drum when said drum is in said horizontal operating position and said hopper unit is in said first position.

25. The laundry machine of claim 23 in which said hydraulic cylinders are operable to pivot said hopper unit through an angle greater than 90 degrees.

26. The laundry machine of claim 25 in which said hydraulic cylinders pivot about said trunnions through an acute angle as an incident to pivoting said hopper unit through an angle greater than 90 degrees.

27. The laundry machine of claim 25 in which the distance between said hopper unit pivot axis and the pivotal connection of the hydraulic cylinder rods to said hopper is less than one-fifth of the depth of the hopper unit.

28. The laundry machine of claim 23 in which said splash door is mounted for movement about a horizontal pivot axis located adjacent a front face of said laundry machine and extending across the top of said chute for pivotal movement between a lowered position closing said chute passage and a raised position extending upwardly from said chute for opening the chute passage for communication with said drum opening.

29. The laundry machine of claim 28 in which said splash door extends downwardly and outwardly at an acute angle to the front face of said machine housing when the splash door is in a lowered closed position and said hopper unit is in said first position, and said splash door actuating device pivots said splash door through an angle greater than 90 degrees during movement between said lowered and raised positions.

30. A laundry machine comprising:

a housing, a drum rotatably mounted within said housing and having a front opening through which launderable items may be introduced and withdrawn, said housing and drum being tiltable between a horizontal operating position and a loading position with the drum opening tilted upwardly and an unloading position with the drum opening tilted downwardly, a hopper unit having a chute that defines a passage, an actuating device for moving said hopper unit between a first position adjacent a front face of said housing wherein said chute passage communicates with said drum opening such that launderable items deposited into said chute are directed into said drum trough said front opening during a loading cycle and a second position in which said chute is located remote from said drum opening to permit removal of launderable items through said drum opening during an unloading cycle, said hopper unit including a splash door that is movable between an opened position for permitting passage of items through said chute passage into said drum opening when said hopper unit in said first position and a closed position in which said splash door at least partially closes said chute passage, a splash door actuating device for moving said splash door between said opened and closed positions, and a locking device for securing said hopper unit in said first position, a seal disposed about a peripheral portion of said chute for positioning against a front face of said housing when said hopper unit is in said first position, said locking device including a pair toggle switches each having a locking arm actable by a respective cylinder, said locking arms being pivotal in response to actuation of said cylinders between an open position which permits movement of said hopper unit from said first to said second position and a locking position which forces the chute in a direction toward the front face of said machine housing with said seal interposed therebetween for creating a water tight seal between the hopper unit and machine housing.

31. The laundry machine of claim 30 in which said chute includes an outwardly extending base plate and a discharge portion projecting rearwardly therefrom for positioning into aligned relation with said drum opening when said hopper unit is in said first position, and said seal being disposed about said rearwardly projecting discharge portion in sealing engagement with a rear face of said base plate.

32. The laundry machine of claim 31 in which said machine housing includes a forward extending sealing flange that is engageable with said seal when said hopper unit is in said first position.

33. The laundry machine of claim 31 including at least one adjustable stop mounted in rearwardly extending relation to said base plate for engagement with the front face of said machine housing for limiting pressure on said seal when said hopper unit is in said first position, and said adjustable stop being threadably engageable with said base plate for adjustable positioning therein.

34. The laundry machine of claim 30 including at least one adjustable stop mounted in rearwardly extending relation to the hopper unit for engagement with the front face of said machine housing for limiting the sealing pressure on said seal when said hopper unit is in said first position.

35. The laundry machine of claim 30 in which said cylinders each have a respective cylinder rod coupled to said locking arm by an overcenter link.

36. The laundry machine of claim 30 in which said cylinders each have a respective cylinder rod coupled to said locking arm, and said cylinders each having a read switch for sensing the position of the respective cylinder rod and hence, the position of the locking arm.

37. The laundry machine of claim 30 in which said hopper unit base plate has a pair of strike plates adjacent a lower end thereof, and said locking arms are engageable with said strike plates when in said locking position.

38. A laundry machine comprising:

a housing, a drum rotatably mounted within said housing and having a front opening through which launderable items may be introduced and withdrawn, a hopper unit having a chute that defines a passage, an actuating device for moving said hopper unit between a first position adjacent a front face of said housing wherein said chute passage communicates with said drum opening such that launderable items deposited into said chute are directed into said drum through said front opening during a loading cycle and a second position in which said chute is located remote from said drum opening to permit removal of launderable items through said drum opening during an unloading cycle, a locking device for securing said hopper unit in said first position, and a seal having a circular cross section interposed between said hopper unit and housing for sealing said hopper unit-to said housing when said hopper unit is in said frost position, said hopper unit and housing defining the sealing surfaces engageable with said seal when said hopper unit is in said first position, said three sealing surfaces each being angularly oriented with respect to each other for imparting at least three point sealing engagement with said sealing member.

39. The laundry machine of claim 38 in which said seal has an elongated tubular construction.

40. The laundry machine of claim 38 in which said hopper defines a first sealing surface located in perpendicular relation to an axis of said drum opening when said hopper unit is in said first position said hopper further defining a second sealing surface disposed at an angle to said first sealing surface, and said housing defines a third sealing surface oriented at an acute angle to said first and second sealing surfaces when said hopper unit is in said first position.

41. The laundry machine of claim 40 in which said third sealing surface is disposed at an angle of about 45° to said first and second sealing surfaces when said hopper unit is in said first position.

42. The laundry machine of claim 41 in which said third sealing surface is defined by a rearwardly and inwardly extending sealing plate oriented at an angle of about 45° to said first and second sealing surfaces when said hopper unit is in said first position.

43. The laundry machine of claim 42 in which said hopper unit has a peripheral base plate, said first sealing surface being located rearwardly of said base plate, and said second sealing surface being defined by an annular spinning extending rearwardly of said base plate and protruding into said machine housing when said hopper unit is in said first position.

44. A laundry machine comprising:

a housing, a drum rotatably mounted within said housing and having a front opening through which launderable items may be introduced and withdrawn said housing and drum being tiltable between a horizontal operating position and a loading position with the drum opening tilted upwardly and an unloading position with the drum opening tilted downwardly, a hopper unit having a chute that defines a passage, an actuating device for moving said hopper unit between a first position adjacent a front face of said housing wherein said chute passage communicates with said drum opening such that launderable items deposited into said chute are directed into said drum through said front opening during a loading cycle and a second position in which said chute is located remote from said drum opening to permit removal of launderable items through said drum opening during an unloading cycle, said hopper unit including a splash door that is movable between a raised open position for permitting passage of items through said chute passage into said drum opening when said hopper unit in s, aid first position and a lowered closed position in which said splash door at least partially closes said chute passage, said splash door being mounted at its upper end on a horizontal pivot shaft extending across the top of the chute and adjacent a front face of said laundry machine when said hopper unit is in said first position, said splash door extending downwardly and outwardly at an acute angle to the front face of said laundry machine when said splash door is in a lowered closed position and said hopper unit is in said first position, and a splash door actuating device for moving said splash door between said lowered closed position and a raised open position.

45. A laundry machine comprising:

a housing, a drum rotatably mounted within said housing and having a front opening through which launderable items may be introduced and withdrawn said housing and drum being tiltable between a horizontal operating position and a loading position with the drum opening tilted upwardly and an unloading position with the drum opening tilted downwardly, a hopper unit having a chute that defines a passage, an actuating device for moving said hopper unit between a first position adjacent a front face of said housing wherein said chute passage communicates with said drum opening through a rear opening of said chute such that launderable items deposited into said chute are directed into said drum through said front opening during a loading cycle and a second position in which said chute is located remote from said drum opening to permit removal of launderable items through said drum opening during an unloading cycle, said hopper unit including a splash door that is movable between a first position for permitting passage of items through said chute passage into said drum opening when said hopper unit in said first position and a second position in which said splash door at least partially closes said chute passage, said splash door having a mounting axis extending across said chute at a location adjacent a top of said rear chute opening and adjacent a front face of said laundry machine when said hopper is in said first position for enabling movement of said splash door between said first and second splash door positions, and a splash door actuating device for moving said splash door between said first and second splash door positions.

* * * * *